US006210118B1

(12) United States Patent
Egawa et al.

(10) Patent No.: US 6,210,118 B1
(45) Date of Patent: Apr. 3, 2001

(54) THIN MOTOR-DRIVEN CENTRIFUGAL BLOWING FAN APPARATUS

(75) Inventors: Yoshihiro Egawa; Mikihiro Terashima, both of Tokyo (JP)

(73) Assignee: Nippon Keiki Works, Ltd., Tokyo (JP)

( * ) Notice: Subject to any disclaimer, the term of this patent is extended or adjusted under 35 U.S.C. 154(b) by 0 days.

(21) Appl. No.: 09/320,215

(22) Filed: May 26, 1999

(30) Foreign Application Priority Data

Dec. 18, 1998 (JP) ..... 10-360208

(51) Int. Cl.[7] ..... F04D 29/38
(52) U.S. Cl. ..... 416/243; 416/DIG. 2
(58) Field of Search ..... 416/183, 185, 416/223 B, 228, 237, DIG. 5, 175, 203; 417/354

(56) References Cited

U.S. PATENT DOCUMENTS 3,794,443 * 2/1974 McCarty ..... 416/175
4,167,369 * 9/1979 Ishihara ..... 416/185
5,188,508 * 2/1993 Scott et al. ..... 415/206
5,226,783 * 7/1993 Mita ..... 416/223 R
5,445,215 * 8/1995 Herbert ..... 165/80.3
5,526,875 * 6/1996 Lin ..... 165/80.3
6,048,024 * 4/2000 Wallman ..... 297/180.13

* cited by examiner

*Primary Examiner*—Edward K. Look
*Assistant Examiner*—James M McAleenan
(74) *Attorney, Agent, or Firm*—Venable; Robert J. Frank; Gabor J. Kelemen

(57) ABSTRACT

A thin motor-driven centrifugal blowing fan apparatus draws in air in a rotation-axis direction and discharges the air in a radial direction. In this fan apparatus, blades are fitted on a peripheral face of a rotor, and each section of the blades in the vicinity of the peripheral face is implanted at an acute angle to the rotation direction so as to form an axial blade section. A section extending from the axial blade section is arranged perpendicular to the rotation direction so as to form a centrifugal blade section.

11 Claims, 5 Drawing Sheets

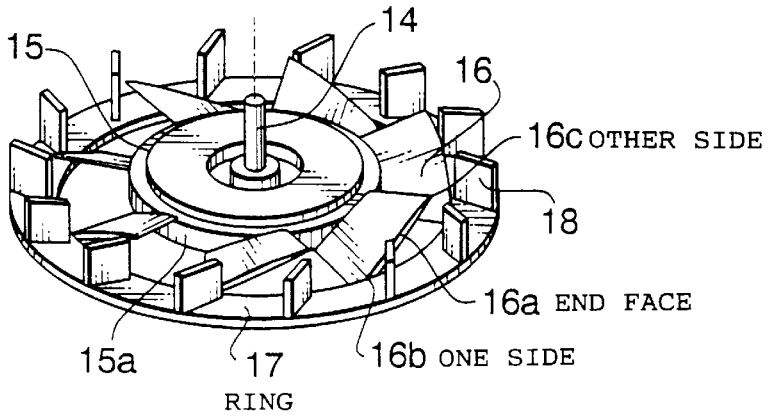
FIG. 5
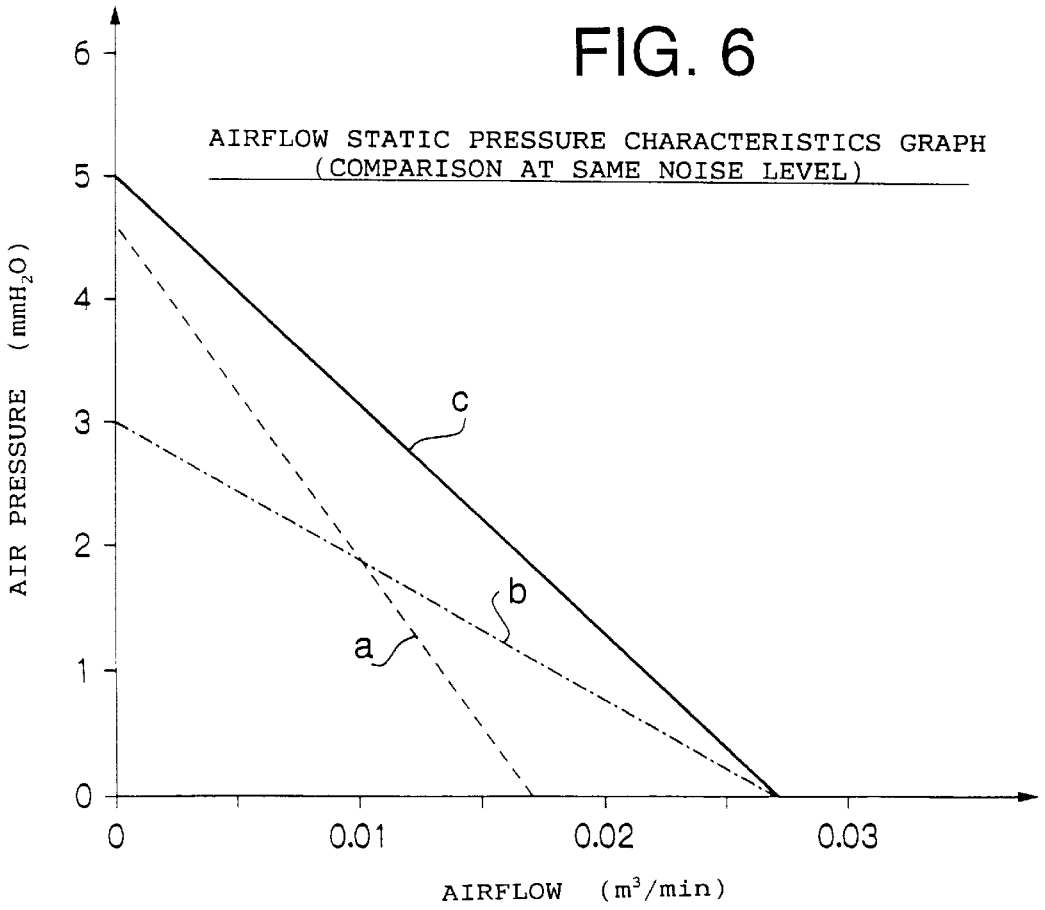

THIN MOTOR-DRIVEN CENTRIFUGAL BLOWING FAN APPARATUS

BACKGROUND OF THE INVENTION

1. Field of the Invention

The present invention relates to a thin motor-driven centrifugal blowing fan apparatus. More particularly it relates to a structure of a blade assembly thereof, which is arranged to draw in air from the direction of the rotation axis and to discharge the air perpendicular to the rotation axis.

2. Description of the Related Art

From the viewpoint of the shape of blades for drawing in and blowing air, structures of blade assemblies of conventional thin motor-driven centrifugal blowing fan apparatuses may be classified into axial fan blade types and centrifugal fan blade types.

In the axial fan blade type, when the space between an inlet and a blade is insufficient, significant air backflow occurs. This makes the operation of drawing in air ineffective, lowering efficiency and, increasing the noise level. This limits applicability of the fan apparatus as it is impossible to use it in areas such as the interiors of electronic and electric devices requiring miniaturization. On the other hand, in the centrifugal fan blade type, air flows along the blades, and the volume of air to be drawn in is determined by the height of the blades. Therefore, the height of the blades must be increased so as to increase the volume of air draw into the apparatus. This interferes with efforts to make the fan apparatus thinner.

FIG. 7A is a perspective view of a fan blade assembly of a conventional axial fan blade type. FIG. 7B is a cross-sectional front view of a portion of a fan apparatus having the fan blade assembly of the axial fan blade type.

A plurality of axial fan blades 22 are formed around a peripheral portion of a rotor 20 fitted on a shaft 21. The fan blade assembly is housed in a thin housing 24. Air is drawn in from the axial direction and is discharged perpendicular to the axial direction. In this case, however, there is significant air backflow after the air hits a bottom portion of the housing 24. This results in ineffective airflow toward the periphery of the blades, reducing the efficiency of discharge to the outlet 23*a*.

FIG. 8A is a perspective view of a fan blade assembly of a centrifugal fan blade type. FIG. 8B is a cross-sectional front view of a portion of a fan apparatus having a blade assembly of the centrifugal fan blade type.

As shown in FIG. 8A, a plurality of centrifugal blades 27 are formed on a peripheral portion of a rotor 29 fitted on a shaft 26. The fan blade assembly is housed in a thin housing 28. Air is drawn in from the axial direction and is discharged perpendicular to the axial direction. In this case, the air which is drawn in flows toward the periphery of the blades; however, unlike the case of the axial fan blade, the drawing in of air is ineffective. The volume of air to be drawn in is determined by the height of the blades; therefore, the volume of air to be discharged from an outlet 28 cannot be increased.

SUMMARY OF THE INVENTION

The present invention is intended to solve the stated above problems. An object of the invention is to provide a thin motor-driven centrifugal blowing fan apparatus having a high capacity to produce airflow in the centrifugal direction.

To achieve the above objects, according to one aspect of the present invention, there is provided a thin motor-driven centrifugal blowing fan apparatus that draws in air in the direction of the rotation axis and discharges the air substantially perpendicular to the rotation axis, including axial blade sections individually arranged at a predetermined acute angle to the rotation direction by using base sections of blades disposed around a peripheral portion of a rotor of the fan apparatus, and centrifugal blade sections individually arranged substantially at an angle of 90 degrees to the rotation direction by using sections extended from the axial blade sections.

The above arrangement may also include sections transformed by being gradually twisted from the axial blade sections to the centrifugal blade sections so as to be bent from the angle of the axial blade sections to the angle of the centrifugal blade sections.

Also, in the above arrangement, the predetermined acute angle may substantially range from 40 to 50 degrees. Also, the diameter of the assembly of the blades may be larger than the diameter of the inlet of the housing. Also, a ring is provided at one side of the centrifugal section.

Furthermore, according to another aspect of the present invention, there is provided a thin motor-driven centrifugal blowing fan apparatus drawing in air in the direction of rotation axis and discharging the air substantially perpendicular to the rotation direction, including axial blades arranged by implanting blades individually around so as to be at predetermined acute angles to the rotation angle, and centrifugal blades arranged by fitting a ring and by implanting blades on a face of the ring so as to be substantially at an angle of 90 degrees to the rotation angle.

In the above arrangement, an inner side face of the ring may be fitted to the end portions of each of the axial blades, and each of the centrifugal blades may be implanted on the ring so as to be arranged toward the other side of the end portions.

Also, in the above arrangement, the predetermined acute angle may substantially range from 40 to 50 degrees. Also, the diameter of an assembly of the blades may be larger than the diameter of an inlet in a housing.

The above arrangements allows implementation of a thin blowing fan apparatus having a high capacity to blow air in the centrifugal direction. In the above arrangements, the diameter of the inlet may be smaller than the blade assembly so as to minimize leakage of air.

BRIEF DESCRIPTION OF THE DRAWINGS

FIG. 5 is a perspective view of a blade assembly in a third embodiment of the present invention.

FIG. 6 is a graph of the airflow static pressure characteristics graph illustrating the comparison between the characteristics of a twisted-blade assembly and conventional blade assemblies.

DESCRIPTION OF THE PREFERRED EMBODIMENTS

Hereinbelow preferred embodiments of the present invention are described with reference to the drawings.

Figure 1A:
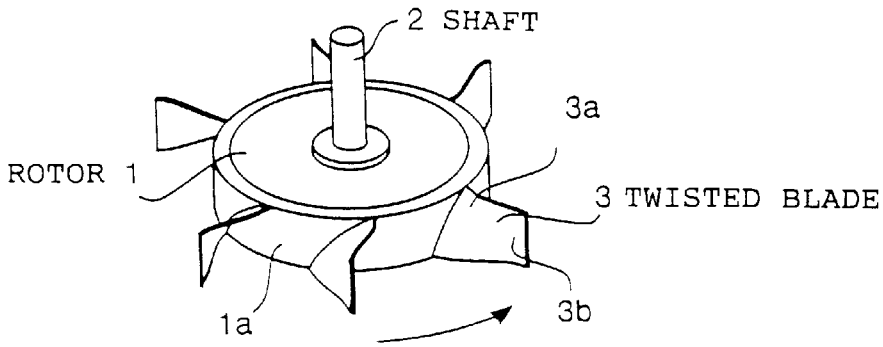
FIG. 1A is a perspective view of a blade assembly of a thin motor-driven centrifugal blowing fan apparatus according to a first embodiment of the present invention.
Figure 1B:
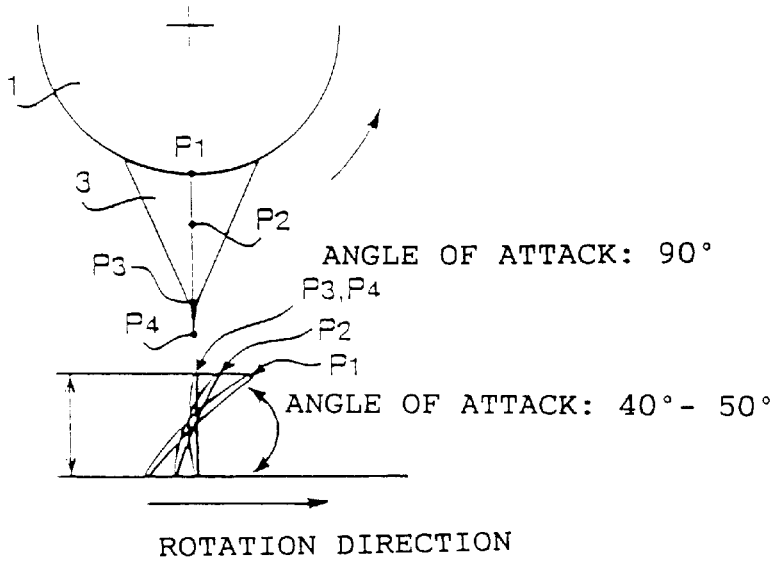
FIG. 1B is a schematic view of the angle of an axial blade section and a centrifugal blade section.

Reference is made to FIGS. 1A and 1B. A thin motor-driven centrifugal blowing fan apparatus has a structure in which a rotor 1 is fitted on a shaft 2, and a plurality of twisted blades 3 are disposed around a peripheral portion 1*a* of the rotor 1. The twisted blade 3 has an axial blade section 3*a* in the vicinity of its base and has a centrifugal blade section 3*b* in a section extending from the axial blade section 3*a*.

The twisted blade 3 start in a position (the position of $P_1$) at an angle ranging from 40 to 50 degrees (angle of attack) to the rotation direction on the peripheral portion la of the rotor 1. The twisted blade 3 is arranged so as to gradually twist from the position $P_1$, so as to pass through the position $P_2$, and so as to be at an angle of 90 degrees (angle of attack) to the rotation direction at the position $P_3$ through the entirety of a tip of the centrifugal blade section.

The twisted blade 3 is rotated in the direction indicated by the arrow so as to function as described below. The axial blade section 3*a* draws in air from an upper portion thereof. The section where the curvature gradually changes from a state of the axial blade section 3*a* to a state of the centrifugal blade section 3*b* changes the direction of the air which was drawn in to a centrifugal direction (a radial direction). Then, the centrifugal blade section 3*b* pushes out the air in a centrifugal direction. The distance between the positions $P_2$ and $P_3$,is less than the height of the twisted blade 3.

Figure 2:
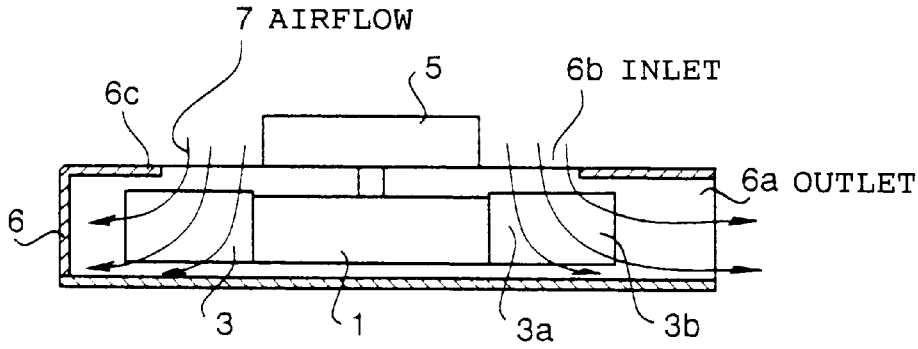
FIG. 2 is a cross-sectional view describing the airflow generated by the thin motor-driven centrifugal blowing fan apparatus of the present invention.

Reference is made to FIG. 2. A motor 5 rotates the rotor 1, and the twisted blade 3 functions as described below. The axial blade section 3*a* draws in air through an inlet 6*b* arranged circularly on an upper face of a housing 6. The centrifugal blade section 3*b* pushes the drawn-in air in a radial direction so as to be discharged through an outlet 6*a*. The outlet 6*a* is arranged on one side of the housing 6. An inlet-forming section 6*c* on an upper face of the housing 6 is arranged in a diameter less than the outside diameter of an assembly of the twisted blade 3 so as to minimize the volume of returning air.

Figure 3:
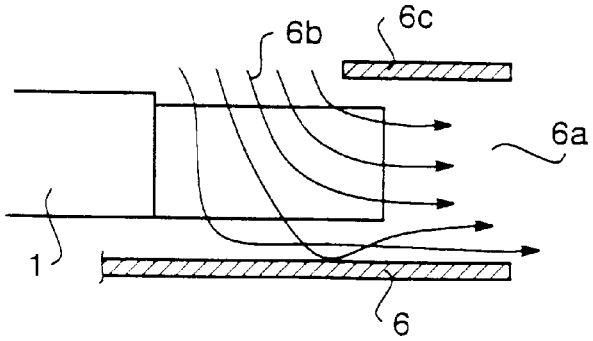
FIG. 3 is an enlarged sectional view of a drawing-in and discharging portion of the fan apparatus in FIG. 2.

Reference is made to FIG. 3. As shown in this figure, air from a motor inlet 6*b* is directed to flow in the direction of the rotation axis. In this case, when a combined structure is made from structures of an axial fan and a centrifugal fan, the air which was drawn in flows smoothly toward a periphery of a twisted-blade assembly so as to be discharged through the outlet 6*a*.

In this way, in an arrangement in which blades are twisted so as to be centrifugal blades toward the periphery, air flows faster as it approaches the blade end. Therefore, air to be returned by collision with a bottom face of the housing is reduced as it approaches the blade end. Air which was drawn in from the vicinity of the center of the rotor is also impelled by air which is flowing in a centrifugal direction (a radial direction) so as to flow smoothly toward the blade end. This improves the efficiency of air discharge, resulting in improvement in performance of the fan apparatus.

Figure 4A:
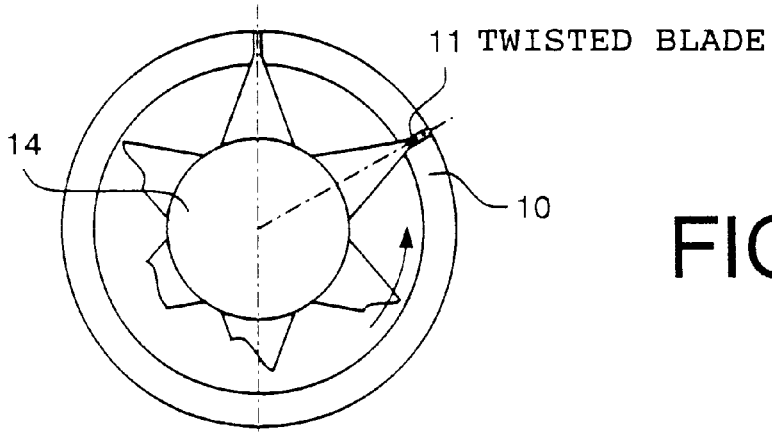
FIG. 4A shows a plan view of a blade assembly in a second embodiment of the present invention.
Figure 4B:
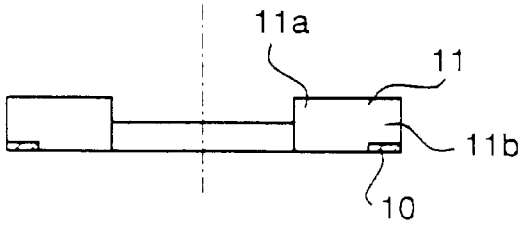
FIG. 4B shows a front view of a blade assembly in a second embodiment of the present invention.
Figure 4C:
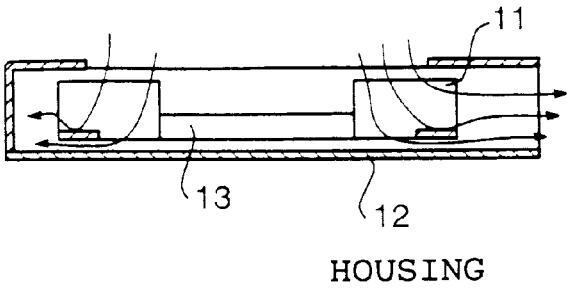
FIG. 4C is a cross-sectional front view of a portion of a fan apparatus in which the blade assembly is mounted.
Figure 7A:
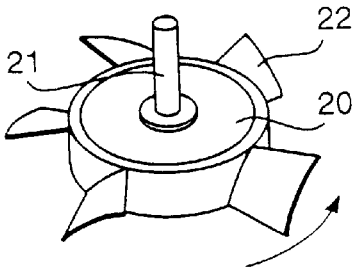
FIG. 7A PRIOR ART
FIG. 7A is a perspective view of a blade assembly of a conventional axial fan blade type.
Figure 7B:
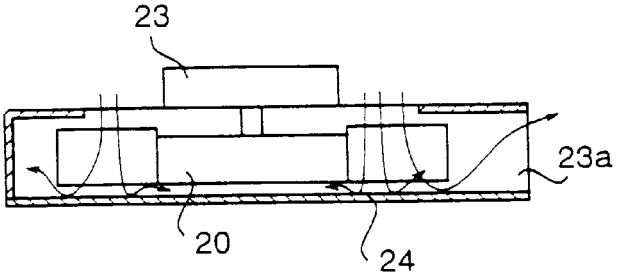
FIG. 7B PRIOR ART
FIG. 7B is a cross-sectional front view of a portion of a fan apparatus in which the blade assembly in FIG. 7A is mounted.
Figure 8A:
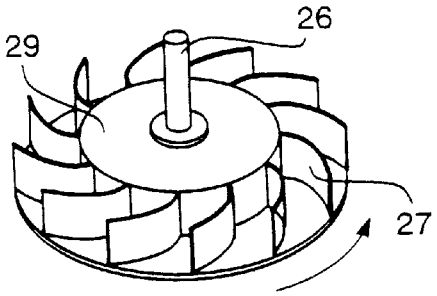
FIG. 8A PRIOR ART
FIG. 8A is a perspective view of a blade assembly of a conventional centrifugal fan blade type.
Figure 8B:
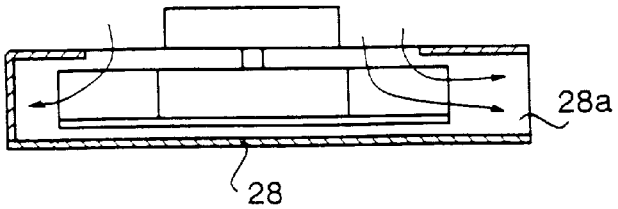
FIG. 8B PRIOR ART
FIG. 8B is a cross-sectional front view of a portion of a fan apparatus in which the blade assembly in FIG. 8A is mounted.

Reference is made to FIGS. 4A, 4B, and 4C showing a second embodiment. This embodiment has twisted blades which are formed on a rotor 14. An axial blade section 11*a* consists of the axial blades and a centrifugal blade section 11*b* consists of the twisted blades. And the centrifugal section has a ring 10. A portion of air which was drawn in the rotation direction contacts an upper portion of the ring 10 and is then guided toward an outlet.

In this way, airflow in the radial direction can be further improved by arrangement of the ring 10 in the centrifugal blade section 11*b* of the blade end.

Reference is made to FIG. 5 showing a third embodiment. In this embodiment, a plurality of axial blades 16 is implanted in a peripheral face 15*a* of a rotor 15 fitted on a shaft 14. The axial blades 16 are individually implanted at an angle ranging from 40 to 50 degrees to the rotation direction.

An inner peripheral face of a ring 17 is fitted on one side 16*b* of an end face 16*a* of the axial blade 16. On an upper face of the ring 16, a plurality of centrifugal blades 18 is formed in the direction of the other side 16*c* of the end face 16*a* of the axial blade 16. The centrifugal blades are fitted individually at an angle of 90 degrees to the rotation direction.

The above arrangement also provides effects equivalent to the case as shown in FIG. 1A. Also, returning air can be minimized so as to further increase smooth airflow in the radial direction.

Reference is made to FIG. 6 showing an airflow static pressure characteristics graph. In this graph, the vertical axis represents static pressures ($mmH_2O$), and the horizontal axis represents the airflow volume per minute ($m^3$/min).

The measurement comparison data represents an example of comparisons among three types of fan apparatuses: a type having blades of a centrifugal fan blade type (curve a), a type having blades of an axial fan blade type (curve b), and a type having twisted blades (curve c). The comparison was made for the same conditions regarding the dimensions of height, depth, and length of housing; the diameter of blade assemblies; and the noise level. The graph of line a indicated by a dotted line represents the fan apparatus having the blades of the centrifugal fan blade type, the graph of line b indicated by a one-dot chain line represents the fan apparatus having the blades of the axial fan blade type, and a graph of line c represents the fan apparatus having twisted blades.

Compared to the graph of line a, the graph of line b is characterized by showing larger airflow volumes corresponding to static pressures. Also, it can be understood that the graph of line c has characteristics in common with the other two graphs of lines. That is, the graph of line c indicates characteristics that, without a change in height of blades, a volume of air which is to be drawn in by the axial fan blade type can be drawn, and concurrently, a volume of air which is to be discharged by the centrifugal fan blade type can be discharged.

As described above, the present invention provides a thin motor-driven centrifugal blowing fan apparatus arranged so that air is drawn in from the direction of the rotation axis, and the air is discharged substantially perpendicular to the rotation axis, by which high performance can be obtained at a rotation rate lower than that in conventional fan apparatuses. Furthermore, because of the lower rotation rate, the present invention contributes to reduction of noise level.

In addition, according to the improvement in the performance and noise level, arrangements can be made such as that the height of the blades is reduced, and the rotation rate is changed to a conventional level. This allows the motor fan apparatus to be formed thinner.

While the invention has been illustrated and described in detail with reference to preferred embodiments thereof, it will be understood that the invention is not restricted thereto, but various other modifications may be incorporated therein without departing from the spirit and scope of the invention.

What is claimed is:

1. A thin, motor-driven centrifugal blowing fan apparatus provided in a housing with an inlet, an outlet and bottom face for drawing in air in the direction of an axis of rotation and discharging the air through the outlet substantially perpendicular to the axis of rotation, comprising:

a rotor centrally located on the axis of rotation and rotating about the axis of rotation in a rotational direction;

a plurality of axial blade sections disposed around a peripheral portion of said rotor and individually arranged at predetermined acute angles to said rotational direction; and a like plurality of centrifugal blade sections, each of said centrifugal blade sections extending from a corresponding axial blade sections and individually arranged substantially at an angle of 90 degrees to said rotational direction through the entirety of a tip of the centrifugal blade section, each of said centrifugal blade sections and said axial blade sections having a bottom edge positioned parallel to the bottom face of the housing.

2. A thin, motor-driven centrifugal blowing fan apparatus according to claim 1, wherein a height of each of said axial blade sections is not greater than a height of each of said centrifugal blade sections.

3. A thin, motor-driven centrifugal blowing fan apparatus according to claim 1, wherein a height of each of said axial blade sections and a height of each of said centrifugal blade sections are the same.

4. A thin, motor-driven centrifugal blowing fan apparatus according to claim 1, further comprising gradually twisted blade sections transformed from said axial blade sections to said centrifugal blade sections so as to be bent from the predetermined acute angle of said axial blade sections to the angle of said centrifugal blade sections.

5. A thin, motor-driven centrifugal blowing fan apparatus according to claim 1, wherein said predetermined acute angles are in the range from about 40 to about 50 degrees.

6. A thin, motor-driven centrifugal blowing fan apparatus according to claim 1, wherein a diameter of said axial blade sections and a diameter of said centrifugal blade sections extending therefrom are larger than a diameter of the inlet in the housing.

7. A thin, motor-driven centrifugal blowing fan apparatus according to claim 1, wherein a ring is provided at the bottom edge of the terminus of said centrifugal blade sections furthest from said axial blade sections.

8. A thin, motor-driven centrifugal blowing fan apparatus provided in a housing with an inlet, an outlet and a bottom face for drawing in air in the direction of an axis of rotation and discharging the air in a direction substantially perpendicular to the rotation axis, comprising:

a rotor centrally located on the axis of rotation and rotating about the axis of rotation in a rotational direction;

a plurality of axial blades disposed around and extending from a peripheral portion of said rotor and individually arranged at predetermined acute angles to said rotational direction;

a ring fixed to said an outermost bottom edge of said axial blades; and a plurality of centrifugal blades disposed separately from said axial blades and on the face of said ring substantially at an angle of 90 degrees to said rotational direction.

9. A motor-driven centrifugal blowing fan apparatus according to claim 8, wherein said predetermined acute angle are in the range from about 40 to about 50 degrees.

10. A motor-driven centrifugal blowing fan apparatus according to claim 8, wherein a diameter of an assembly of said blades is larger than a diameter of the inlet in the housing.

11. A motor-driven centrifugal blowing fan apparatus according to claim 8, wherein a height of said axial blades and a height of said centrifugal blades are the same.

* * * * *